US009701913B2

(12) United States Patent
Lippmann et al.

(10) Patent No.: US 9,701,913 B2
(45) Date of Patent: Jul. 11, 2017

(54) FLUID CATALYTIC CRACKING PROCESS INCLUDING ADSORPTION OF HYDROGEN AND A CATALYST FOR THE PROCESS

(71) Applicant: UOP LLC, Des Plaines, IL (US)

(72) Inventors: Matthew Lippmann, Chicago, IL (US); Alex A. Rio, Des Plaines, IL (US); Keith A. Couch, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 696 days.

(21) Appl. No.: 14/108,384

(22) Filed: Dec. 17, 2013

(65) Prior Publication Data

US 2015/0166431 A1 Jun. 18, 2015

(51) Int. Cl.

| | |
|---|---|
| ***B01J 21/00*** | (2006.01) |
| ***B01J 23/00*** | (2006.01) |
| ***B01J 25/00*** | (2006.01) |
| ***B01J 29/00*** | (2006.01) |
| ***C10G 11/18*** | (2006.01) |
| ***C10G 11/02*** | (2006.01) |

(52) U.S. Cl.

CPC ..... *C10G 11/18* (2013.01); *C10G 11/02* (2013.01)

(58) Field of Classification Search

USPC ..... 502/300, 100, 150

See application file for complete search history.

(56) References Cited

U.S. PATENT DOCUMENTS

| | | | | |
|---|---|---|---|---|
| 4,309,279 A | | 1/1982 | Chester et al. | |
| 4,992,400 A | | 2/1991 | Marcilly et al. | |
| 6,580,009 B2 * | | 6/2003 | Schwab | C07C 7/163 585/324 |
| 7,087,802 B2 * | | 8/2006 | Schindler | B01J 23/96 585/654 |
| 7,582,805 B2 * | | 9/2009 | Frenzel | B01J 23/48 585/261 |
| 2003/0172808 A1 * | | 9/2003 | Le Bec | C01B 3/56 95/96 |

(Continued)

FOREIGN PATENT DOCUMENTS

WO 2012166472 A2 12/2012

OTHER PUBLICATIONS

Kang, "Ruthenium Nanoparticles Supported on Carbon Nanotubes as Efficient Catalysts for Selective Conversion of Synthesis Gas to Diesel Fuel", Angew. Chem. 2009, 121, 2603-2606.

(Continued)

*Primary Examiner* — James McDonough

(57) ABSTRACT

A process for catalytic cracking includes the steps of: (a) contacting a hydrocarbon feed with a catalyst at catalytic cracking conditions; (b) adsorbing hydrogen on the catalyst during cracking; and (c) producing a cracked product, preferably propylene, wherein the catalyst comprises (i) a matrix, (ii) a catalytically active material, and (iii) a hydrogen adsorption material. Another process for catalytic cracking includes the steps of: (a) contacting a hydrocarbon feed with a catalyst at catalytic cracking conditions; (b) contacting the hydrocarbon feed with a hydrogen adsorption material; (c) adsorbing hydrogen on the hydrogen adsorption material during cracking; and (d) producing a cracked product, wherein the catalyst comprises (i) a matrix and (ii) a catalytically active material.

16 Claims, 1 Drawing Sheet

(56) References Cited

U.S. PATENT DOCUMENTS

| | | | | |
|---|---|---|---|---|
| 2007/0099299 | A1 | 5/2007 | Simon et al. | |
| 2011/0171121 | A1 * | 7/2011 | Senderov | C01B 39/026 423/704 |

OTHER PUBLICATIONS

King, "Direct Evidence for Spillover of Hydrogen from Ruthenium to Copper in Supported Cu—Ru/SiO2 Catalysts: A Study by NMR of Chemisorbed Hydrogen", J. Am. Chem. Soc. 1986, 108, 6056-6058.

Stumbo, "Spillover hydrogen effect on amorphous hydrocracking catalysts", Catalysis Letters 31 (1995) 173-182.

Search Report dated Feb. 27, 2015 for corresponding PCT Appl. No. PCT/US2014/068269.

* cited by examiner

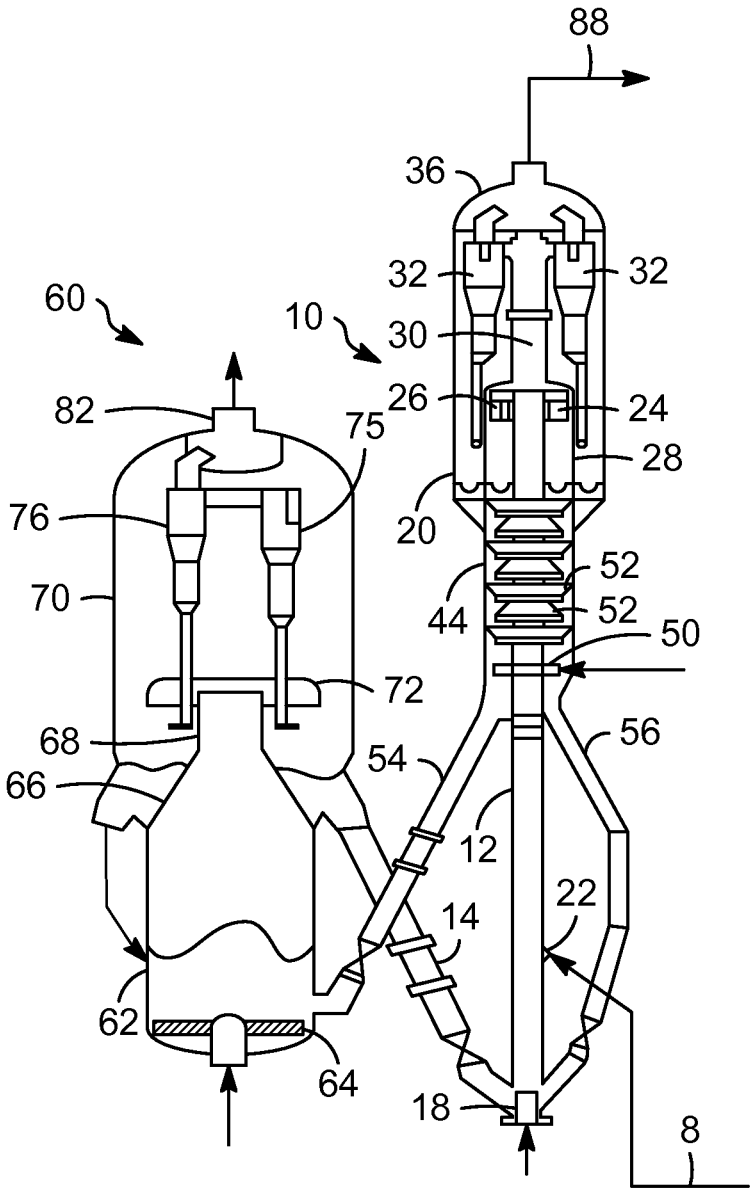
88
36
32
32
60
10
30
82
26
24
75
28
76
20
52
70
44
52
50
72
68
56
54
66
12
22
14
62
64
18
8

FLUID CATALYTIC CRACKING PROCESS INCLUDING ADSORPTION OF HYDROGEN AND A CATALYST FOR THE PROCESS

BACKGROUND

This invention generally relates to fluid catalytic cracking (FCC) applications. FCC is a catalytic hydrocarbon conversion process accomplished by contacting heavier hydrocarbons in a fluidized reaction zone with a catalytic particulate material. The reaction in catalytic cracking, as opposed to hydrocracking, is carried out in the absence of substantial added hydrogen or the consumption of hydrogen. As the cracking reaction proceeds substantial amounts of highly carbonaceous material referred to as coke are deposited on the catalyst to provide coked or spent catalyst. Vaporous lighter products are separated from spent catalyst in a reactor vessel. Spent catalyst may be subjected to stripping over an inert gas such as steam to strip entrained hydrocarbonaceous gases from the spent catalyst. A high temperature regeneration with oxygen within a regeneration zone operation burns coke from the spent catalyst which may have been stripped. Various products may be produced from such a catalytic hydrocarbon conversion process, including a naphtha product and/or a light product such as propylene and/or ethylene.

Propylene is an important starting material in the petrochemical industry for the production of higher olefins, polypropylene and many other important products. Commercially there is a demand for FCC technology capable of producing high propylene yields from conventional feedstocks. The first step taken to increase FCC propylene yield is to add a medium pore zeolite catalyst, such as ZSM-5, to the catalyst blend. ZSM-5 catalyses cracking of gasoline range olefins to light olefins and will achieve 10-12 wt % propylene yield at standard FCC conditions. In order to increase propylene yield further, adding a product recycle to the reactor system or decreasing unit hydrocarbon partial pressure is necessary. Both methods significantly increase unit capital cost, Decreasing hydrocarbon partial pressure increases FCC propylene yield by reducing hydrogen transfer between olefins and larger more stable molecules. Hydrogen transfer between olefins and larger molecules at adjacent catalyst active sites can reduce olefin yield in exchange for increased cyclic-olefin, saturates, and aromatic yields. By decreasing hydrocarbon partial pressure, the probability that molecules are adsorbed to adjacent active sites is reduced, therefore decreasing the chances of hydrogen transfer between molecules. The drawback to operating at low partial pressure is that actual volumetric flow rate at process conditions is increased for the same mass flow rate due to operating at lower unit pressure and increased steam rates; resulting in higher capital costs.

What is needed is a means to reduce hydrogen transfer between molecules on the FCC catalyst without decreasing hydrocarbon partial pressure. This invention proposes the addition of a hydrogen adsorption material into FCC catalyst that adsorbs hydrogen released from larger more stable molecules. By adsorbing hydrogen, the adsorption material will competitively inhibit hydrogen from being transferred from larger molecules to olefinic molecules at adjacent active sites on the catalyst. Such a material would help achieve the propylene yield benefit observed by decreasing hydrocarbon partial pressure without having to increase capital cost of the unit.

SUMMARY

An embodiment is a process for catalytic cracking comprising (a) contacting a hydrocarbon feed with a catalyst at catalytic cracking conditions; (b) adsorbing hydrogen on the catalyst or an additive during cracking; and (c) producing a cracked product wherein the catalyst comprises (i) a matrix and (ii) a catalytically active material; and either the catalyst or the additive comprises a hydrogen adsorption material. Another embodiment of the invention further comprises (d) recovering the catalyst and perhaps the additive from the hydrocarbon feed; (e) regenerating the catalyst to yield a regenerated catalyst; (f) desorbing hydrogen during regeneration; and (g) contacting the regenerated catalyst with the hydrocarbon feed.

It is therefore an advantage of the invention to provide a process for reducing intermolecular hydrogen transfer reactions, resulting in increased FCC propylene yield.

It is another advantage of the invention to provide an FCC catalyst or an additive capable of adsorbing hydrogen in order to promote production of propylene while simultaneously reducing undesirable hydrogen transfer reactions.

In high propylene FCC applications, hydrogen transfer reactions that saturate light olefins are very undesirable because they limit propylene yield. Designing an FCC process for low hydrocarbon partial pressures to reduce hydrogen transfer significantly increases the cost of the FCC unit.

It would be desirable to adsorb hydrogen on a catalyst or additive used in fluid catalytic cracking (FCC) applications. Hydrogen adsorption would be achieved by incorporating a hydrogen adsorptive material into the FCC catalyst structure or an additive. The FCC catalyst or additive that can be used with an FCC catalyst has hydrogen adsorption properties that adsorb hydrogen during the FCC reaction process and then release the hydrogen during a regeneration cycle. The hydrogen adsorption material limits hydrogen transfer reactions ultimately leading to higher light olefin yields, while reducing the need to design a unit with low hydrocarbon partial pressure.

These and other features, aspects, and advantages of the present invention will become better understood upon consideration of the following detailed description, drawings and appended claims.

BRIEF DESCRIPTION OF THE DRAWING

The FIGURE is a schematic drawing of a typical fluid catalytic cracking process with a reactor, catalyst recovery and regeneration.

DETAILED DESCRIPTION

As used herein, the following terms have the corresponding definitions. The term "communication" means that material flow is operatively permitted between enumerated components. The term "downstream communication" means that at least a portion of material flowing to the subject in downstream communication may operatively flow from the object with which it communicates. The term "upstream communication" means that at least a portion of the material flowing from the subject in upstream communication may operatively flow to the object with which it communicates. The term "direct communication" means that flow from the upstream component enters the downstream component without undergoing a compositional change due to physical fractionation or chemical conversion.

The FCC process can be used to implement the present invention. Therefore, the FIGURE is shown to provide context for the present invention. The FIGURE depicts a first catalytic reactor 10 and a regenerator vessel 60. Many configurations of an FCC unit are possible, but specific embodiments are presented herein by way of example. All other possible embodiments for carrying out the present invention are considered within the scope of the present invention.

A conventional FCC feedstock and higher boiling hydrocarbon feedstock are a suitable first feed 8 to the first FCC reactor. The most common of such conventional feedstocks is a "vacuum gas oil" (VGO), which is typically a hydrocarbon material having a boiling range of from 343° C. to 552° C. (650° F. to 1025° F.) prepared by vacuum fractionation of atmospheric residue. Such a fraction is generally low in coke precursors and heavy metal contamination which can serve to contaminate catalyst. Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons and the foregoing list is not comprehensive. Moreover, additional amounts of feed may also be introduced downstream of the initial feed point.

The first reactor 10 which may be a catalytic or an FCC reactor that includes a first reactor riser 12 and a first reactor vessel 20. A regenerator pipe 14 is in upstream communication with the first reactor riser 12. The regenerator pipe 14 delivers regenerated catalyst particles (which include a matrix, a catalytically active material, and hydrogen adsorption material) or delivers catalyst particles (which include a matrix and a catalytically active material) and regenerated hydrogen adsorption additive (which comprises a hydrogen adsorption material) from the regenerator vessel 60 at a rate regulated by a control valve to the reactor riser 12 through a regenerated catalyst inlet. A fluidization medium such as steam from a distributor 18 urges a stream of regenerated particles upwardly through the first reactor riser 12. At least one feed distributor 22 in upstream communication with the first reactor riser 12 injects the first hydrocarbon feed 8, preferably with an inert atomizing gas such as steam, across the flowing stream of catalyst/hydrogen adsorption material particles or the flowing stream of catalyst particles and hydrogen adsorption material to distribute hydrocarbon feed to the first reactor riser 12. Upon contacting the hydrocarbon feed with catalyst in the first reactor riser 12, the heavier hydrocarbon feed cracks to produce lighter gaseous first cracked products while conversion coke and contaminant coke precursors are deposited on the catalyst particles to produce spent catalyst.

The first reactor vessel 20 is in downstream communication with the first reactor riser 12. The resulting mixture of gaseous product hydrocarbons and spent catalyst/hydrogen adsorption material continues upwardly through the first reactor riser 12 and are received in the first reactor vessel 20 in which the spent catalyst/hydrogen adsorption material and gaseous product are separated. A pair of disengaging arms 24 may tangentially and horizontally discharge the mixture of gas and catalyst/hydrogen adsorption material from a top of the first reactor riser 12 through one or more outlet ports 26 (only one is shown) into a disengaging vessel 28 that effects partial separation of gases from the catalyst/hydrogen adsorption material. A transport conduit 30 carries the hydrocarbon vapors, including stripped hydrocarbons, stripping media and entrained catalyst/hydrogen adsorption material to one or more cyclones 32 in the first reactor vessel 20 which separates spent catalyst/hydrogen adsorption material from the hydrocarbon gaseous product stream. The disengaging vessel 28 is partially disposed in the first reactor vessel 20 and can be considered part of the first reactor vessel 20.

Gas conduits deliver separated hydrocarbon gaseous streams from the cyclones 32 to a collection plenum 36 in the first reactor vessel 20 for passage to a product line 88 via an outlet nozzle for product recovery. Diplegs discharge catalyst/hydrogen adsorption material from the cyclones 32 into a lower bed in the first reactor vessel 20. The catalyst/hydrogen adsorption material with adsorbed or entrained hydrocarbons may eventually pass from the lower bed into an optional stripping section 44 across ports defined in a wall of the disengaging vessel 28. Catalyst/hydrogen adsorption material separated in the disengaging vessel 28 may pass directly into the optional stripping section 44 via a bed. A fluidizing distributor 50 delivers inert fluidizing gas, typically steam, to the stripping section 44. The stripping section 44 contains baffles 52 or other equipment to promote contacting between a stripping gas and the catalyst/hydrogen adsorption material. The stripped spent catalyst/hydrogen adsorption material leaves the stripping section 44 of the disengaging vessel 28 of the first reactor vessel 20 with a lower concentration of entrained or adsorbed hydrocarbons than it had when it entered or if it had not been subjected to stripping. A first portion of the spent catalyst/hydrogen adsorption material, preferably stripped of hydrocarbons, leaves the disengaging vessel 28 of the first reactor vessel 20 through a spent catalyst conduit 54 and passes into the regenerator vessel 60 at a rate regulated by a slide valve. The regenerator vessel 60 is in downstream communication with the first reactor 10. A second portion of the spent catalyst/hydrogen adsorption material is recirculated in recycle conduit 56 from the disengaging vessel 28 back to a base of the riser 12 at a rate regulated by a slide valve to recontact the feed without undergoing regeneration. The first cracked products in the line 88 from the first reactor 10, relatively free of catalyst particles and including the stripping fluid, exit the first reactor vessel 20 through the outlet nozzle. The first cracked products stream in the line 88 may be subjected to additional treatment to remove fine catalyst particles or to further prepare the stream prior to fractionation.

The first reactor riser 12 can operate at any suitable temperature, and typically operates at a temperature of about 150° to about 580° C., preferably about 520° to about 580° C. at the riser outlet 24. In one example embodiment, a higher riser temperature may be desired, such as no less than about 565° C. at the riser outlet port 24 and a pressure of from about 69 to about 517 kPa (gauge) (10 to 75 psig) but typically less than about 275 kPa (gauge) (40 psig). The catalyst-to-oil ratio, based on the weight of catalyst and feed hydrocarbons entering the bottom of the riser, may range up to 30:1 but is typically between about 4:1 and about 10:1 and may range between 7:1 and 25:1. Hydrogen is not normally added to the riser. Steam may be passed into the first reactor riser 12 and first reactor vessel 20 equivalent to about 2 to 35 wt % of feed. Typically, however, the steam rate may be between about 2 and about 7 wt % for maximum gasoline production and about 10 to about 15 wt % for maximum light olefin production. The average residence time of catalyst in the riser may be less than about 5 seconds.

The FCC process of the FIGURE can convert the hydrocarbon feedstock into an olefin, such as propylene. However undesirable hydrogen transfer reactions can occur resulting in the conversion of propylene to propane. A process of the invention can reduce the amount of hydrogen present in the FCC unit in order to prevent undesirable hydrogen transfer reactions and produce greater yields of light olefin products including propylene.

In one example version of the process of the invention, the catalyst introduced into the first reactor 10 is a single catalyst or a mixture of different catalysts that adsorb hydrogen during cracking. Each catalyst can be in the form of solid particles comprising a matrix, a catalytically active material, and a hydrogen adsorption material. The catalyst solid particles promote the conversion of the hydrocarbon feedstock into an olefin, and also adsorb excess hydrogen during the FCC process.

The matrix materials are often, to some extent, porous in nature and may or may not be effective to promote the desired hydrocarbon conversion. For example, the matrix materials may promote conversion of the hydrocarbon feedstock into an olefin, such as propylene. Non-limiting example matrix materials include synthetic and naturally occurring substances such as metal oxides, clays (e.g., kaolin), silicas, aluminas, silica-aluminas, silica-magnesias, silica-zirconias, silica-thorias, silica-berylias, silica-titanias, silica-alumina-thorias, silica-alumina-zirconias, aluminophosphates, mixtures of these and the like.

The catalytically active material can be a catalyst used in FCC, such as an active amorphous clay-type catalyst and/or a high activity, crystalline molecular sieve. Zeolites may be used as molecular sieves in FCC processes. Zeolites are microporous, aluminosilicate minerals. The catalytically active material can be a mixtures of a zeolite catalyst and non-zeolite matrix such as aluminum silicate. The zeolitic molecular sieves may have a large average pore size. Usually, molecular sieves with a large pore size have pores with openings of greater than about 0.7 nanometers in effective diameter defined by greater than about 10, and typically about 12, member rings. Pore Size Indices of large pores can be above about 31. Suitable large pore zeolite components may include synthetic zeolites such as X and Y zeolites, mordenite and faujasite. Medium or smaller pore zeolite catalysts, such as a MFI zeolite, as exemplified by at least one of ZSM-5, ZSM-11, ZSM-12, ZSM-23, ZSM-35, ZSM-38, ZSM-48, and other similar materials may be suitable. Other suitable medium or smaller pore zeolites include ferrierite, and erionite. Rare earth metals that are not hydrogen adsorption materials should be kept below 0.01 wt-% in the catalyst because they promote hydrogen transfer reactions.

The hydrogen adsorption material may comprise nonporous amorphous carbons, graphite, graphene, fullerenes, activated carbons, metal-organic frameworks, chemically modified carbon adsorbents, such as scandium or titanium decorated fullerenes, alkali metal doped graphene and pillared graphite structures, metal-doped (e.g., potassium-doped) carbon adsorbents, titanium dioxide, copper-ruthenium bimetallic catalysts, magnesia-supported cesium-ruthenium bimetallic catalysts, and mixtures thereof. Preferred hydrogen adsorption material includes titanium dioxide, copper-ruthenium bimetallic catalysts, and magnesia-supported cesium-ruthenium bimetallic catalysts.

The solid particles of the catalyst can be formed in a number or ways. In one non-limiting example, kaolin, water, silica binder, a zeolite, and the hydrogen adsorption material can be mixed, spray dried, and calcined to form the solid particles of the catalyst. Alternatively, the matrix material can be formed into microspheres which are then coated with a pre-crystallized zeolite, or the zeolite can be directly formed in situ in the pores of the microsphere. The hydrogen adsorption material can then be deposited on the matrix material by a process such as vapor phase deposition. For example, the catalytic vapor phase deposition of carbon materials is suitable.

The composition of the catalyst solid particles can vary depending on the catalytic activity and hydrogen adsorption characteristics desired. The matrix may comprise 1 to 98 wt %, or 5 to 90 wt %, or 10 to 80 wt %, or 20 to 70 wt %, or 30 to 60 wt % based on the total weight percentage of the catalyst solid particles. The catalytically active material may comprise 1 to 98 wt %, or 5 to 90 wt %, or 10 to 80 wt %, or 20 to 70 wt %, or 30 to 60 wt % based on the total weight percentage of the catalyst solid particles. The hydrogen adsorption material may comprise 1 to 98 wt %, or 5 to 90 wt %, or 10 to 80 wt %, or 20 to 70 wt %, or 30 to 60 wt % based on the total weight percentage of the catalyst solid particles. A preferred catalyst includes 50 to 90 wt % of a matrix, 10 to 50 wt % of a catalytically active material, and 1 to 10 wt % of a hydrogen adsorption material. The catalyst solid particles may have a particle size of about 10 to about 200 micrometers. Preferably, the catalyst solid particles have a mean particle size of about 50 to about 100 micrometers.

In another example version of the process of the invention, the catalyst introduced into the first reactor 10 is a single catalyst or a mixture of different catalysts. Each catalyst can be in the form of solid particles comprising a matrix and a catalytically active material. The matrix and the catalytically active material can be the materials described above. The hydrogen adsorption material is introduced into the first reactor 10 in a form that is separate or not chemically or physically associated with the catalyst solid particles. The hydrogen adsorption material may be fed to the reactor 10 unsupported on a matrix or may be deposited on a matrix material distinct from the catalyst similar to the way it can be deposited on a matrix of the catalyst solid particles. In such a case, the hydrogen adsorption material includes 90 to 99 wt % of a matrix and 1 to 10 wt % of a hydrogen adsorption material.

The catalyst solid particles promote the conversion of the hydrocarbon feedstock into an olefin during the FCC process. The hydrogen adsorption material adsorbs excess hydrogen during the FCC process. During FCC reaction, the hydrogen adsorption material adsorbs hydrogen. During FCC regeneration, the hydrogen adsorption material desorbs the hydrogen.

The hydrogen adsorption material may be hydrogen adsorptive at a temperature of between about 260° and about 620° C., preferably between about 520° and about 580° C. at pressures from about 69 to about 517 kPa (gauge). The hydrogen adsorption material may be hydrogen desorptive at a temperature of between about 590° and about 800° C., preferably between about 650° and about 760° C. at pressures from about 69 to about 517 kPa (gauge). The hydrogen adsorption material particles have a particle size of 10 micrometers to 200 micrometers. Preferably, the hydrogen adsorption material particles have a mean particle size of about 50 micrometers to about 100 micrometers.

The regenerator vessel 60 is in downstream communication with the first reactor vessel 20. Depending on the version of the process used, either (i) catalyst particles comprising a matrix, a catalytically active material, and a hydrogen adsorption material, or (ii) catalyst particles comprising a matrix and a catalytically active material, and separate hydrogen adsorption material that may comprise a matrix, are introduced into the regenerator vessel 60. In the regenerator vessel 60, (1) coke is combusted and hydrogen is desorbed from the catalyst particles comprising a matrix, a catalytically active material, and a hydrogen adsorption material that may comprise a matrix, or (2) coke is combusted from the catalyst particles comprising a matrix and a catalytically active material, and hydrogen is desorbed from the hydrogen adsorption material that are delivered to the regenerator vessel 60 to provide regenerated catalyst and hydrogen adsorption material. The regenerator vessel 60 typically operates at a temperature of about 594° to about 760° C. and operates at about the same pressure as in the FCC reactor 10.

The regenerator vessel 60 may be a combustor type of regenerator as shown in the FIGURE, but other regenerator vessels and other flow conditions may be suitable for the present invention. The spent catalyst conduit 54 feeds spent catalyst to a first or lower chamber 62 defined by an outer wall through a spent catalyst inlet. A combustion gas, typically air, enters the lower chamber 62 of the regenerator vessel 60 through a conduit and is distributed by a distributor 64. As the combustion gas enters the lower chamber 62, it contacts spent catalyst entering from spent catalyst conduit 54. A combustor-type, regenerator vessel 60 typically operates at a temperature of about 594° to about 704° C. in the lower chamber 62 and operates at about the same pressure as in the FCC reactor 10.

The mixture of catalyst, hydrogen adsorption material and combustion gas in the lower chamber 62 ascend through a frustoconical transition section 66 to the transport, riser section 68 of the lower chamber 62. The riser section 68 defines a tube which is preferably cylindrical and extends preferably upwardly from the lower chamber 62. The mixture of catalyst and gas travels at a higher superficial gas velocity than in the lower chamber 62. The increased gas velocity is due to the reduced cross-sectional area of the riser section 68 relative to the cross-sectional area of the lower chamber 62 below the transition section 66.

The regenerator vessel 60 also may include an upper or second chamber 70. The mixture of catalyst particles, hydrogen adsorption material and flue gas is discharged from an upper portion of the riser section 68 into the upper chamber 70. Substantially completely regenerated catalyst and hydrogen adsorption material may exit the top of the transport, riser section 68. Discharge is effected through a disengaging device 72 that separates a majority of the regenerated catalyst and hydrogen adsorption material from the flue gas. In an embodiment, catalyst and hydrogen adsorption material and gas flowing up the riser section 68 impact a top elliptical cap of a disengaging device 72 and reverse flow. The catalyst and hydrogen adsorption material and gas then exit through downwardly directed discharge outlets of the disengaging device 72. The sudden loss of momentum and downward flow reversal cause a majority of the heavier catalyst and hydrogen adsorption material to fall to the dense catalyst bed and the lighter flue gas and a minor portion of the catalyst still entrained therein to ascend upwardly in the upper chamber 70. Cyclones 75, 76 further separate catalyst and hydrogen adsorption material from ascending gas and deposits catalyst and hydrogen adsorption material through diplegs into dense catalyst bed. Flue gas exits the cyclones 75, 76 through a gas conduit and collects in a plenum 82 for passage to an outlet nozzle of regenerator vessel 60. The combustor-type, regenerator vessel 60 typically operates at a temperature of about 649° to about 760° C. in the upper chamber 70 and operates at about the same pressure as in the FCC reactor 10. The hotter temperature in the regenerator vessel causes the hydrogen adsorption material to desorb the hydrogen in the regenerator vessel 60. The desorbed hydrogen is collected by the cyclones 75, 76 and processed along with the flue gas through plenum 82.

Regenerated catalyst and hydrogen adsorption material from dense catalyst bed is transported through regenerated catalyst pipe 14 from the regenerator vessel 60 back to the first reactor riser 12 through the control valve where it again contacts the first feed in line 8 as the FCC process continues.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

SPECIFIC EMBODIMENTS

While the following is described in conjunction with specific embodiments, it will be understood that this description is intended to illustrate and not limit the scope of the preceding description and the appended claims.

A first embodiment of the invention is a process for catalytic cracking comprising (a) contacting a hydrocarbon feed with a catalyst at catalytic cracking conditions; (b) adsorbing hydrogen on the catalyst during cracking; and (c) producing a cracked product wherein the catalyst comprises (i) a matrix; (ii) a catalytically active material; and (iii) a hydrogen adsorption material. An embodiment of the invention is one, any or all of prior embodiments in this paragraph up through the first embodiment in this paragraph further comprising (d) recovering the catalyst from the hydrocarbon feed; (e) regenerating the catalyst to yield a regenerated catalyst; (f) desorbing hydrogen during regeneration; and (g) contacting the regenerated catalyst with the hydrocarbon feed. An embodiment of the invention is one, any or all of prior embodiments in this paragraph up through the first embodiment in this paragraph wherein the hydrogen adsorptive material is on the matrix with the catalytically active metal. An embodiment of the invention is one, any or all of prior embodiments in this paragraph up through the first embodiment in this paragraph wherein the hydrogen adsorptive material is separate from the matrix on which the catalytically active metal is deposited. An embodiment of the invention is one, any or all of prior embodiments in this paragraph up through the first embodiment in this paragraph wherein the hydrogen adsorption material is selected from the group consisting of nonporous amorphous carbons, graphite, graphene, fullerenes, activated carbons, metal-organic frameworks, chemically modified carbon adsorbents, alkali metal doped graphene structures, pillared graphite structures, metal-doped carbon adsorbents, and mixtures thereof. An embodiment of the invention is one, any or all of prior embodiments in this paragraph up through the first embodiment in this paragraph wherein the hydrogen adsorption material is selected from the group consisting of titanium dioxide, copper-ruthenium bimetallic catalysts, magnesia-supported cesium-ruthenium bimetallic catalysts, and mixtures thereof. An embodiment of the invention is one, any or all of prior embodiments in this paragraph up through the first embodiment in this paragraph wherein the cracked product comprises propylene.

A second embodiment of the invention is a process for catalytic cracking comprising (a) contacting a hydrocarbon feed with a catalyst at catalytic cracking conditions; (b) contacting the hydrocarbon feed with a hydrogen adsorption material; (c) adsorbing hydrogen on the hydrogen adsorption material during cracking; and (d) producing a cracked product wherein the catalyst comprises (i) a matrix; and (ii)

a catalytically active material. An embodiment of the invention is one, any or all of prior embodiments in this paragraph up through the second embodiment in this paragraph further comprising (e) recovering the catalyst from the hydrocarbon feed; (f) regenerating the catalyst to yield a regenerated catalyst; (g) desorbing the hydrogen from the catalyst during regeneration; and (h) contacting the regenerated catalyst with the hydrocarbon feed. An embodiment of the invention is one, any or all of prior embodiments in this paragraph up through the second embodiment in this paragraph wherein the matrix comprises a matrix material selected from the group consisting of metal oxides, clays, silicas, aluminas, silica-aluminas, silica-magnesias, silica-zirconias, silica-thorias, silica-berylias, silica-titanias, silica-alumina-thorias, silica-alumina-zirconias, aluminophosphates, and mixtures thereof. An embodiment of the invention is one, any or all of prior embodiments in this paragraph up through the second embodiment in this paragraph wherein the catalytically active material comprises a microporous, aluminosilicate. An embodiment of the invention is one, any or all of prior embodiments in this paragraph up through the second embodiment in this paragraph wherein the hydrogen adsorption material is selected from the group consisting of nonporous amorphous carbons, graphite, graphene, fullerenes, activated carbons, metal-organic frameworks, chemically modified carbon adsorbents, alkali metal doped graphene structures, pillared graphite structures, metal-doped carbon adsorbents, and mixtures thereof. An embodiment of the invention is one, any or all of prior embodiments in this paragraph up through the second embodiment in this paragraph wherein the hydrogen adsorption material is selected from the group consisting of titanium dioxide, copper-ruthenium bimetallic catalysts, magnesia-supported cesium-ruthenium bimetallic catalysts, and mixtures thereof. An embodiment of the invention is one, any or all of prior embodiments in this paragraph up through the second embodiment in this paragraph wherein the cracked product comprises propylene.

A third embodiment of the invention is a catalytic cracking catalyst which adsorbs hydrogen during catalytic cracking, the catalyst comprising a matrix; a catalytically active material; and a hydrogen adsorption material. An embodiment of the invention is one, any or all of prior embodiments in this paragraph up through the third embodiment in this paragraph further comprising a matrix material selected from the group consisting of metal oxides, clays, silicas, aluminas, silica-aluminas, silica-magnesias, silica-zirconias, silica-thorias, silica-berylias, silica-titanias, silica-alumina-thorias, silica-alumina-zirconias, aluminophosphates, and mixtures thereof. An embodiment of the invention is one, any or all of prior embodiments in this paragraph up through the third embodiment in this paragraph wherein the catalytically active material comprises a microporous, aluminosilicate. An embodiment of the invention is one, any or all of prior embodiments in this paragraph up through the third embodiment in this paragraph wherein the hydrogen adsorption material is selected from the group consisting of nonporous amorphous carbons, graphite, graphene, fullerenes, activated carbons, metal-organic frameworks, chemically modified carbon adsorbents, alkali metal doped graphene structures, pillared graphite structures, metal-doped carbon adsorbents, and mixtures thereof. An embodiment of the invention is one, any or all of prior embodiments in this paragraph up through the third embodiment in this paragraph wherein the hydrogen adsorption material is selected from the group consisting of titanium dioxide, copper-ruthenium bimetallic catalysts, magnesia-supported cesium-ruthenium bimetallic catalysts, and mixtures thereof. An embodiment of the invention is one, any or all of prior embodiments in this paragraph up through the third embodiment in this paragraph wherein the matrix further comprises a hydrogen adsorption material.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for catalytic cracking comprising:

(a) contacting a hydrocarbon feed with a catalyst at catalytic cracking conditions;

(b) adsorbing hydrogen on the catalyst during cracking; and (c) producing a cracked product wherein the catalyst comprises:

(i) a matrix;

(ii) a catalytically active material; and (iii) a hydrogen adsorption material, wherein the hydrogen adsorption material is selected from the group consisting of nonporous amorphous carbons, graphite, graphene, fullerenes, activated carbons, metal-organic frameworks, chemically modified carbon adsorbents, alkali metal doped graphene structures, pillared graphite structures, metal-doped carbon adsorbents, and mixtures thereof.

2. The process of claim 1 further comprising:

(d) recovering the catalyst from the hydrocarbon feed;

(e) regenerating the catalyst to yield a regenerated catalyst;

(f) desorbing hydrogen during regeneration; and (g) contacting the regenerated catalyst with the hydrocarbon feed.

3. The process of claim 1 wherein: the hydrogen adsorptive material is on the matrix with the catalytically active metal.

4. The process of claim 1 wherein: the hydrogen adsorptive material is separate from the matrix on which the catalytically active metal is deposited.

5. The process of claim 1 wherein the hydrogen adsorption material is selected from the group consisting of nonporous amorphous carbons, graphite, graphene, fullerenes, activated carbons, metal-organic frameworks, chemically modified carbon adsorbents, alkali metal doped graphene structures, pillared graphite structures, metal-doped carbon adsorbents, and mixtures thereof.

6. The process of claim 1 wherein the hydrogen adsorption material is selected from the group consisting of titanium dioxide, copper-ruthenium bimetallic catalysts, magnesia-supported cesium-ruthenium bimetallic catalysts, and mixtures thereof.

7. The process of claim 1 wherein the cracked product comprises propylene.

8. The process of claim 1 wherein the matrix comprises a matrix material selected from the group consisting of metal oxides, clays, silicas, aluminas, silica-aluminas, silica-magnesias, silica-zirconias, silica-thorias, silica-berylias, silica-titanias, silica-alumina-thorias, silica-alumina-zirconias, aluminophosphates, and mixtures thereof.

9. The process of claim 1 wherein the catalytically active material comprises a microporous, aluminosilicate.

10. A process for catalytic cracking comprising:

(a) contacting a hydrocarbon feed with a catalyst at catalytic cracking conditions;

(b) adsorbing hydrogen on the catalyst during cracking; and (c) producing a cracked product wherein the catalyst comprises:

(i) a matrix;

(ii) a catalytically active material; and (iii) a hydrogen adsorption material, wherein the hydrogen adsorption material is selected from the group consisting of titanium dioxide, copper-ruthenium bimetallic catalysts, magnesia-supported cesium-ruthenium bimetallic catalysts, and mixtures thereof.

11. The process of claim 10 further comprising:

(d) recovering the catalyst from the hydrocarbon feed;

(e) regenerating the catalyst to yield a regenerated catalyst;

(f) desorbing hydrogen during regeneration; and (g) contacting the regenerated catalyst with the hydrocarbon feed.

12. The process of claim 10 wherein: the hydrogen adsorptive material is on the matrix with the catalytically active metal.

13. The process of claim 10 wherein: the hydrogen adsorptive material is separate from the matrix on which the catalytically active metal is deposited.

14. The process of claim 10 wherein the cracked product comprises propylene.

15. The process of claim 10 wherein the matrix comprises a matrix material selected from the group consisting of metal oxides, clays, silicas, aluminas, silica-aluminas, silica-magnesias, silica-zirconias, silica-thorias, silica-berylias, silica-titanias, silica-alumina-thorias, silica-alumina-zirconias, aluminophosphates, and mixtures thereof.

16. The process of claim 10 wherein the catalytically active material comprises a microporous, aluminosilicate.

* * * * *